US010250996B1

(12) United States Patent
Holzmann

(10) Patent No.: US 10,250,996 B1
(45) Date of Patent: Apr. 2, 2019

(54) METHOD AND APPARATUS OF A SWITCHED MICROPHONE INTERFACE CIRCUIT FOR VOICE ENERGY DETECTION

(71) Applicant: Nuvoton Technology Corporation, Hsinchu (TW)

(72) Inventor: Peter Holzmann, San Jose, CA (US)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 15/803,837

(22) Filed: Nov. 6, 2017

(51) Int. Cl.
*H04R 19/01* (2006.01)
*H04R 1/04* (2006.01)

(52) U.S. Cl.
CPC ..... *H04R 19/016* (2013.01); *H04R 1/04* (2013.01); *H04R 2410/03* (2013.01); *H04R 2499/11* (2013.01)

(58) Field of Classification Search
USPC ..... 381/91–92, 111, 113, 122
See application file for complete search history.

(56) References Cited

U.S. PATENT DOCUMENTS 4,629,910 A * 12/1986 Early ..... H03F 3/1855 327/530
9,961,440 B2 * 5/2018 Gabai ..... H04R 19/005
2010/0310096 A1 * 12/2010 Josefsson ..... H04R 3/06 381/113
2012/0140950 A1 * 6/2012 Poulsen ..... H04R 29/004 381/94.1
2014/0056442 A1 * 2/2014 Anazawa ..... H03F 3/2173 381/120
2015/0244406 A1 * 8/2015 Abdullah ..... H04B 1/385 455/90.2
2016/0337751 A1 * 11/2016 Gabai ..... H04R 19/005
2017/0142519 A1 * 5/2017 Lasseuguette ..... G10L 19/22

* cited by examiner

*Primary Examiner* — Disler Paul
(74) *Attorney, Agent, or Firm* — Kilpatrick Townsend & Stockton LLP

(57) ABSTRACT

An acoustic energy detection circuit can include a microphone interface circuit configured for coupling to a microphone. The microphone interface circuit is configured to intermittently activate the microphone to detect acoustic energy and convert the acoustic energy to an electrical signal. The acoustic energy detection circuit also includes a comparator circuit for receiving the electrical signal and comparing the electrical signal with a threshold signal. The comparator circuit is configured to output an output signal to indicate detection of acoustic energy.

18 Claims, 12 Drawing Sheets

METHOD AND APPARATUS OF A SWITCHED MICROPHONE INTERFACE CIRCUIT FOR VOICE ENERGY DETECTION

BACKGROUND OF THE INVENTION

This invention relates generally to the field of electronic circuits. More particularly, some embodiments of the invention are directed to detection of acoustic signals in a low-power circuit configuration.

Acoustic signals, such as voice, are usually detected using microphones, which can be used in many applications such as telephones, hearing aids, public address systems for concert halls and public events, motion picture production, live and recorded audio engineering, sound recording, two-way radios, megaphones, radio and television broadcasting, and in computers for recording voice, speech recognition, VoIP, and for non-acoustic purposes such as ultrasonic sensors or knock sensors.

Several different types of microphones are in use, which employ different methods to convert the air pressure variations of a sound wave to an electrical signal. A condenser microphone uses the vibrating diaphragm as a capacitor plate. An electret microphone is a type of electrostatic capacitor-based microphone using a permanently charged material. An electret is a stable dielectric material with a permanently embedded static electric dipole moment. For example, electret microphones can use polytetrafluoroethylene (PTFE) plastic, either in film or solute form, to form the electret. An electret microphone capsule may include an electret microphone and a field effect transistor (FET), which usually needs a power supply. Conventional circuits often have separate bias circuit and a voice detection processing circuit, and the DC bias is known to consume power.

Power consumption is a great concern, as voice command applications in mobile devices are becoming more popular. Voice command processing that requires high energy can be performed in the cloud. However, the circuitry that enables the voice command processing is still implemented on the mobile devices and requires energy from the mobile device battery. The circuits that process audio signals picked up by the microphone often consumes substantial power, because these circuits are typically always running as a voice command or keyword can arrive at any time.

Therefore, for power-efficient implementation and long battery life, it is desirable to have very low power circuits that process audio signals picked up by the microphone.

BRIEF SUMMARY OF THE INVENTION

Some embodiments of the invention are directed to detection of acoustic sound in a low-power circuit configuration. In some embodiments, a simple circuit is provided for both microphone bias and voice processing. For example, the microphone bias and voice processing functions can be integrated in a circuit using only one transistor. The microphone can be activated intermittently or periodically at low duty cycles to reduce power consumption in, for example, voice signal detection in voice command applications. Audio output signals can be provided without a decoupling capacitor, which can enable fast turn-on and turn-off of the microphone. In conventional circuits, separate bias circuit and a voice detection processing circuit are needed. Conventional circuits often have a large decoupling capacitor to extract an AC output audio signal. To activate and deactivate the microphone, the large capacitor needs to be charged and discharged, which can limit the speed of the circuit and consume power.

Some embodiments are described below that use a low power electret microphone interface circuits as an example, in particular to those used for voice activity detection in mobile voice command applications. However, it is understood that embodiments of the invention are not limited to these applications. For example, embodiments of the invention can also be used for acoustic signal detection outside the voice band, for example, detection of glass breaking, or other types detection where it is desirable to reduce power consumption.

According to some embodiments of the invention, a microphone interface circuit is provided for coupling to a microphone. The microphone interface circuit is configured to intermittently provide a current to activate the microphone to detect acoustic energy and convert the acoustic energy to an electrical signal. In some cases, the microphone is activated periodically.

In some embodiments of the invention, the microphone interface circuit has only one field effect transistor (FET). The same FET can provide a DC current to an electret microphone during the power up state, and gain up the microphone AC signal and provide an amplified output signal between the drain and gate during the power up state. In some embodiments, the FET has a switch coupled to the gate and a switch coupled to the drain in order to switch the FET in a power up state and a power off state. In some cases, the switching frequency of the switch control signal is twice the targeted bandwidth of the acoustic energy to be detected. In an embodiment, the FET can have the same DC bias on the gate and drain during the power up state.

According to some embodiments of the invention, a microphone interface circuit includes a field effect transistor (FET) and a first switch and a second switch for coupling the FET to an electret microphone for intermittently detecting acoustic energy. The FET is configured to provide a DC bias current to the electret microphone, provide same DC bias on a gate connection and a drain connection of the FET, and provide output audio samples between the gate and drain for further processing.

In some embodiments the microphone interface circuit includes an MOS transistor having a source, a gate, and a drain, with the source configured for coupling to a first power supply terminal. It is noted that the term "field effect transistor (FET)," "metal-oxide-semiconductor (MOS) transistor," and "MOSFET (metal-oxide-semiconductor field effect transistor)" are used interchangeably in the description below. A first switch is coupled to the drain of the MOS transistor, and the first switch is also configured for coupling to a first terminal of the microphone. The microphone has a second terminal for coupling to a second power supply terminal. The microphone interface circuit also includes a bias circuit having a first capacitor coupled in series with an RC circuit, which has a parallel combination of a resistor and a second capacitor. The first capacitor is configured for coupling to the first power supply terminal. A second switch is coupled to the RC circuit, and the second switch is also configured for coupling to the first terminal of the microphone. The microphone interface circuit is configured for receiving a microphone power-up signal for intermittently turning on and off the first switch and the second switch for activating and deactivating the microphone.

In some embodiments, the microphone interface circuit also includes a third switch coupled between the first capacitor and the drain of the MOS transistor. The third switch is configured to receive a precharge signal for charging up the first capacitor.

The microphone power-up signal can be a pulsed control signal. In an embodiment, the pulsed control signal has a duty cycle of less than 10% for low-power operation. In another embodiment, the pulsed control signal has a duty cycle of less than 30% for low-power operation. In a specific embodiment, the pulsed control signal has an on time of 10 μsec in each period of 125 μsec. In some embodiments, the pulsed control signal has variable periods of on time and off time.

In some embodiments, the microphone comprises an electret microphone.

Alternatively, the microphone comprises an acoustic energy transducer configured for detecting subsonic, sonic, or supersonic acoustic energy.

According to some embodiments of the invention, a microphone interface circuit is configured for capacitor-less coupling to a microphone. The microphone interface circuit includes only a single field-effect transistor (FET) configured to provide a current to activate the microphone to detect acoustic energy. The single field-effect transistor (FET) is also configured to, after detection of acoustic energy, amplify AC signal from the microphone and provide an amplified output audio signal for further processing.

According to some embodiments of the invention, an acoustic energy detection circuit can include a microphone interface circuit configured for coupling to a microphone. The microphone interface circuit is configured to intermittently activate the microphone to detect acoustic energy and convert the acoustic energy to an electrical signal. The acoustic energy detection circuit also includes a comparator circuit for receiving the electrical signal and comparing the electrical signal with a threshold signal. The comparator circuit is configured to output an output signal to indicate detection of acoustic energy.

In some embodiments of the above acoustic energy detection circuit, the acoustic energy detection circuit is configured to precharge the microphone interface circuit in response to a precharge signal, to intermittently provide a current to activate the microphone to detect acoustic energy in a low-power operation mode in response to a pulsed microphone power-up signal. After detection of acoustic energy, the acoustic energy detection circuit maintains the microphone in an activated state for acoustic energy processing.

In some embodiments, the microphone interface circuit is configured to provide a current to the microphone at constant time periods. In alternative embodiments, the microphone interface circuit is configured to provide a current to the microphone at variable time periods.

The acoustic energy detection circuit can also include latches and a decision logic circuit for keeping track a number of times the electrical signal exceeds the threshold signal before indicating detection of acoustic energy.

DETAILED DESCRIPTION OF THE INVENTION

Voice command applications in mobile devices are becoming more popular. The circuits that process audio signals detected by the microphone often consumes substantial power, because these circuits are typically always running as a voice command or keyword that can arrive at any time. For power efficient implementation and long battery life, it is desirable to have very low power circuits that process audio signal detected by the microphone.

Typically, the sequence for activating the voice command processing is as follows:

1) Acoustic energy detection. This detects any incoming sound energy and, if detected, it can enable the circuits required for further discrimination between voice energy and other sounds in step 2). The circuit used for the acoustic energy detection includes the low power Electret Microphone Interface Circuit as described in this application. The first stage triggers subsequent stages, which consume more power;

2) Voice detection. This can be done by an algorithm or circuit that needs to reject noise and music, but flag voice inputs. If a voice is detected, then the keyword detection in step 3) is initiated;

3) Keyword detection. This detects if the voice input contains a system keyword (like 'Siri', 'Ok Google', 'Alexa')

required for voice commands. If the keyword is detected, then voice command processing in step 4) is initiated;

4) Voice command processing. This can be carried out on an external server and system dependent;

Every step described above is often gated, such that the most power or data consuming steps are less likely to be triggered by false sound triggers. This allows the mobile system to operate at low power. Embodiments of the invention can handle the microphone circuit for acoustic energy detection, which needs to be enabled and, therefore, its power dissipation is critical.

Figure 1:
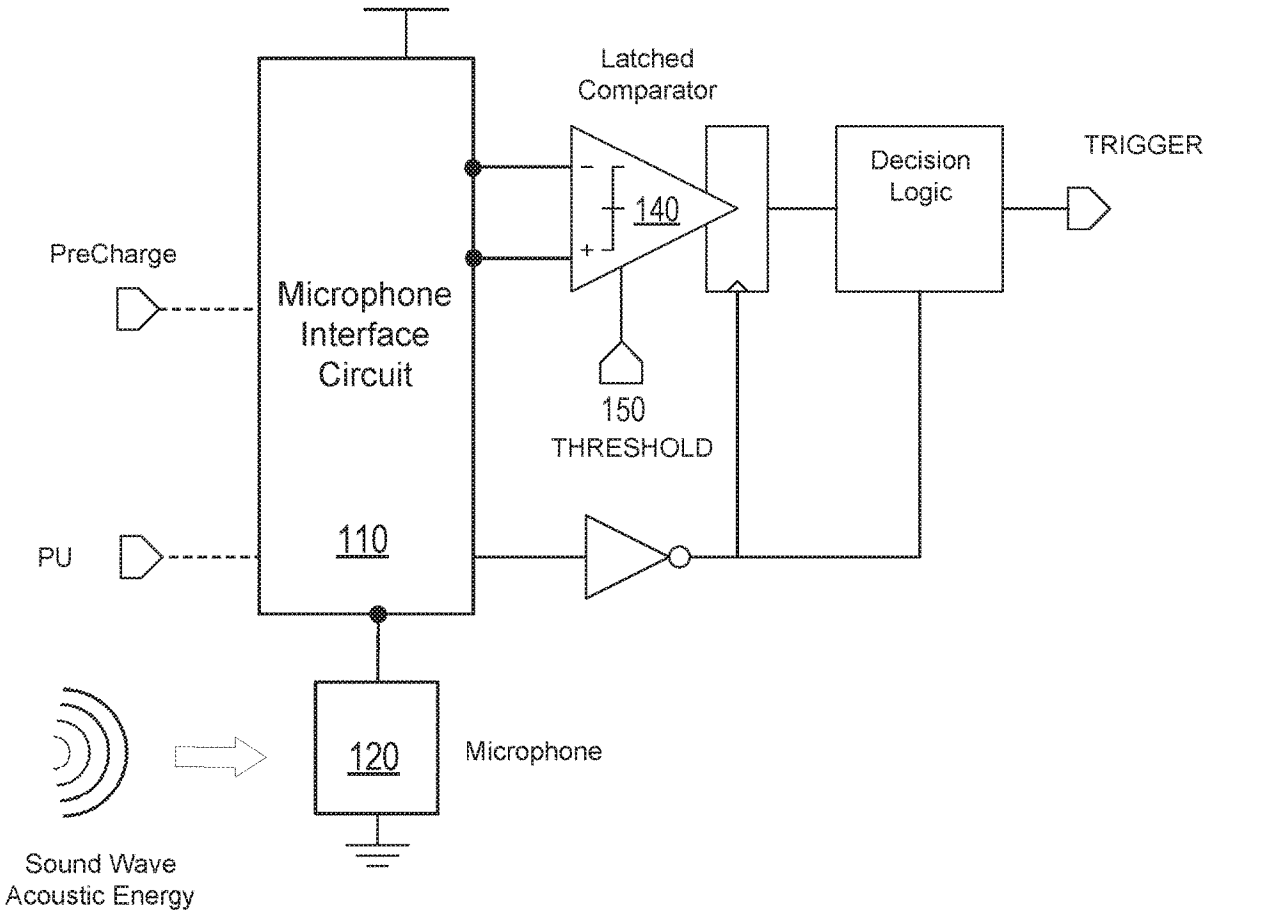
FIG. 1 is a simplified block diagram illustrating an acoustic energy detection circuit according to some embodiments of the present invention.

FIG. 1 is a simplified block diagram illustrating an acoustic energy detection circuit according to some embodiments of the present invention. As shown in FIG. 1, acoustic energy detection circuit 100 includes a microphone interface circuit 110 configured for coupling to a microphone 120. The microphone interface circuit 110 is configured to intermittently provide a current to activate the microphone to detect acoustic energy and convert the acoustic energy to an electrical signal. Acoustic energy detection circuit 100 also has a comparator circuit 140 for receiving the electrical signal and comparing the electrical signal with a threshold signal 150. The acoustic energy detection circuit 100 is configured to output an output signal TRIGGER to indicate detection of acoustic energy. Other components in acoustic energy detection circuit 100 are described below.

Figure 2A:
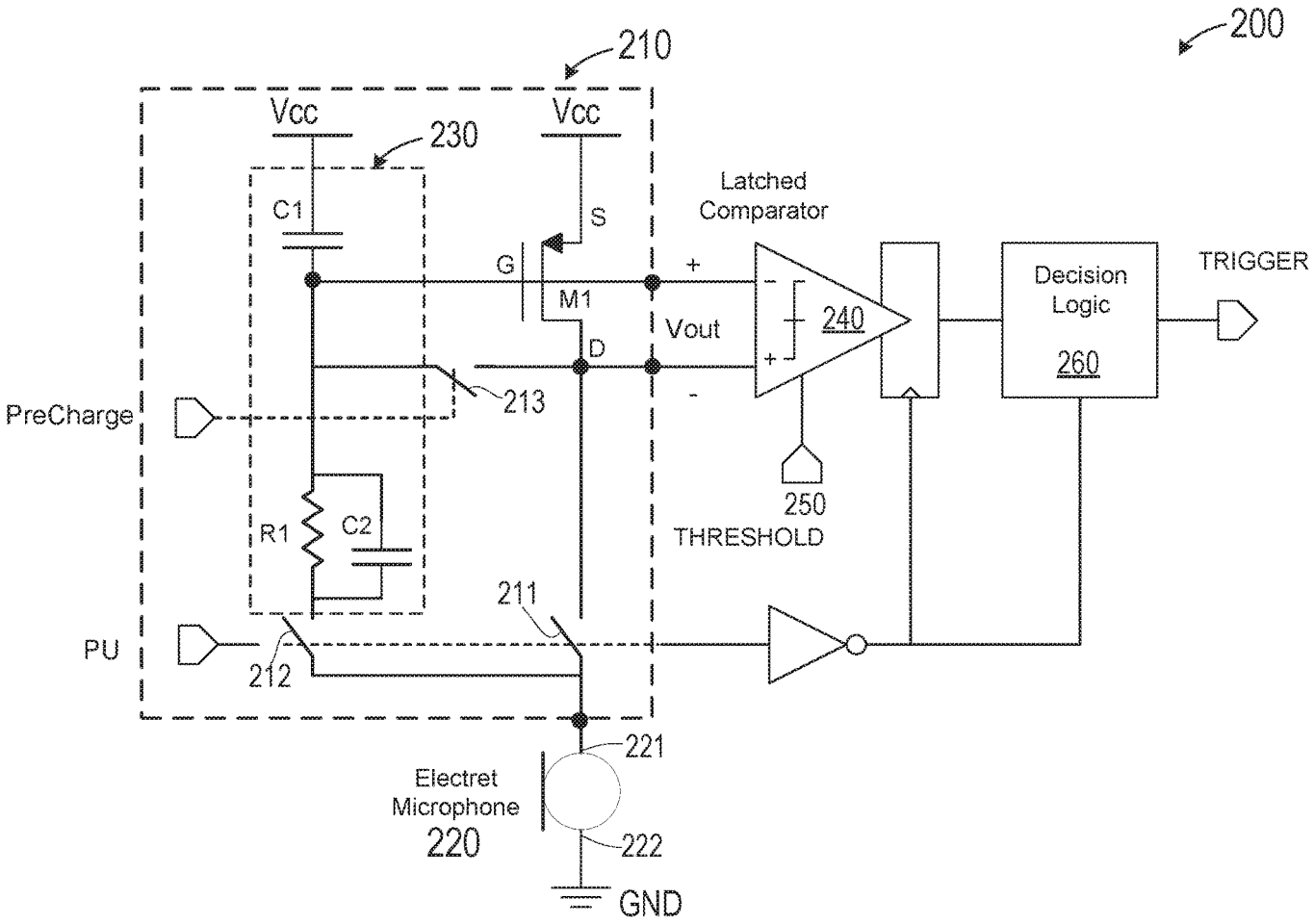
FIG. 2A is a schematic diagram illustrating an acoustic energy detection circuit according to some embodiments of the present invention.

FIG. 2A is a schematic diagram illustrating an acoustic energy detection circuit according to some embodiments of the present invention. As shown in FIG. 2A, acoustic energy detection circuit 200 includes a microphone interface circuit 210 configured for coupling to a microphone 220. The microphone interface circuit 210 is configured to intermittently provide a current to activate the microphone to detect acoustic energy and convert the acoustic energy to an electrical signal. Acoustic energy detection circuit 200 also has a comparator circuit 240 for receiving the electrical signal and comparing the electrical signal with a threshold signal. The acoustic energy detection circuit 200 is configured to output an output signal TRIGGER to indicate detection of acoustic energy.

In FIG. 2A, a circuit diagram is shown to illustrate an exemplary implementation of microphone interface circuit 210 according to an embodiment of the present invention. In this embodiment, microphone interface circuit 210 includes an MOS transistor M1 having a source S, a gate G, and a drain D. The source S of MOS transistor M1 is configured for coupling to a first power supply terminal. In this example, the first power supply terminal can be a power supply terminal Vcc. A first switch 211 is coupled to the drain D of MOS transistor M1. The first switch 211 is also configured for coupling to a first terminal 221 of the microphone 220. The microphone 220 also has a second terminal 222 for coupling to a second power supply terminal. In this example, the second power supply terminal can be an electrical ground terminal GND. In alternative embodiments, the first and second power supply terminals can refer to the ground and power supply terminal, respectively.

Microphone interface circuit 210 also includes a bias circuit 230 having a first capacitor C1 coupled in series with an RC circuit. The first capacitor C1 is configured for coupling to the first power supply terminal Vcc. The RC circuit has a parallel combination of a resistor R1 and a second capacitor C2. A second switch 212 is coupled to the RC circuit of resistor R1 and second capacitor C2. The second switch 212 is also configured for coupling to the first terminal 221 of the microphone 220. The interface circuit 210 is configured for receiving a microphone power-up signal PU for intermittently, or periodically, turning on and off the first switch 211 and the second switch 212 for activating and deactivating the microphone.

In some embodiments, the interface circuit 210 also includes a third switch 213 coupled between the first capacitor C1 and the drain D of the MOS transistor. The third switch 213 is configured to receive a precharge signal PreCharge for charging up the first capacitor C1. The third switch 213 is used by the acoustic energy detection circuit to precharge the interface circuit in response to the precharge signal PreCharge before the start of the acoustic energy detection.

Figure 2B:
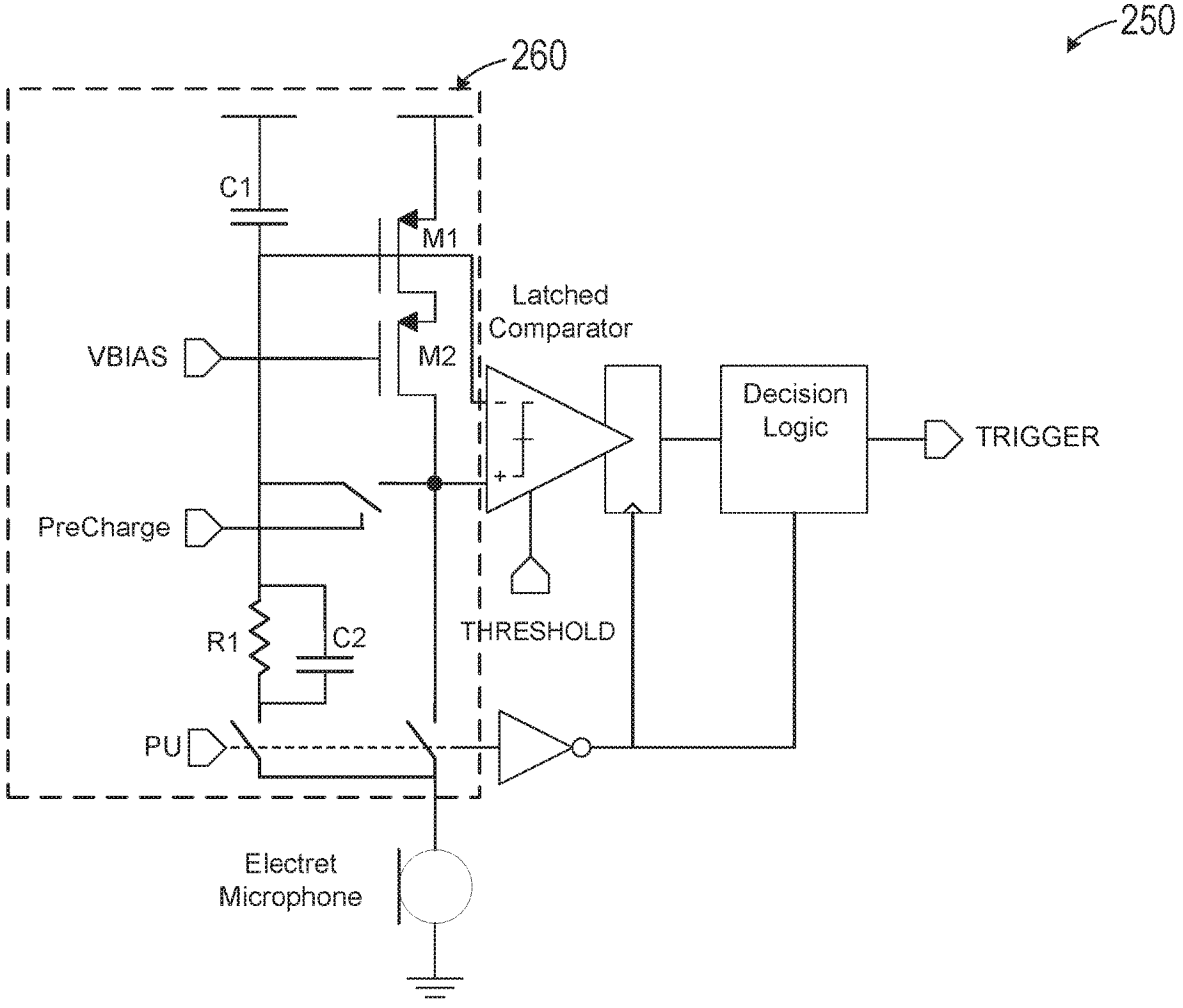
FIG. 2B is a schematic diagram illustrating an acoustic energy detection circuit including a cascaded transistor according to embodiments of the present invention.

FIG. 2B is a schematic diagram illustrating an acoustic energy detection circuit according to alternative embodiments of the present invention. As shown in FIG. 2B, acoustic energy detection circuit 250 includes components similar to acoustic energy detection circuit 200 of FIG. 2A, and performs similar functions. The microphone interface circuit 260 is also configured to intermittently provide a current to activate the microphone to detect acoustic energy and convert the acoustic energy to an electrical signal. A difference between acoustic energy detection circuit 250 and acoustic energy detection circuit 200 in FIG. 2A is that microphone interface circuit 260 in FIG. 2B has a cascaded transistor circuit including MOSFET transistors M1 and M2, instead of a single transistor M1 in FIG. 2A. As shown in FIG. 2B, transistor M2 is coupled in series with transistor M1. Further, transistor M2 is also biased with a bias voltage VBIAS. The function of the cascaded transistor circuit is explained further with reference to FIG. 2C.

Figure 2C:
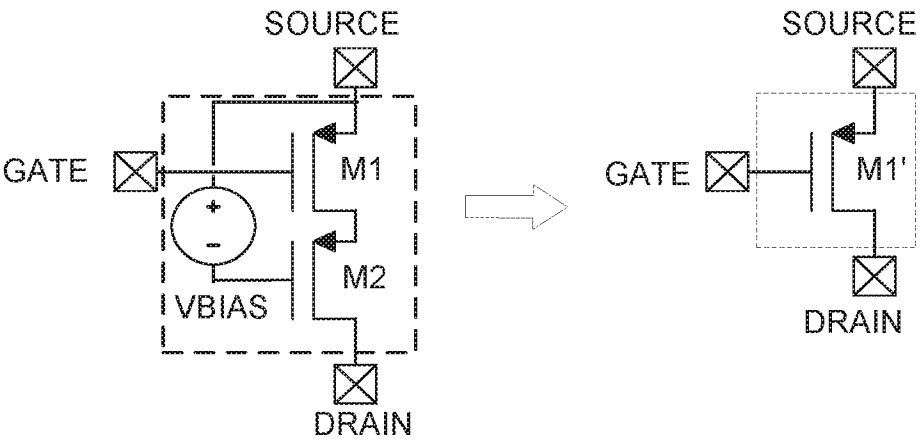
FIG. 2C is a schematic diagram illustrating a cascaded transistor circuit according to some embodiments of the present invention.

FIG. 2C is a schematic diagram illustrating a cascaded transistor circuit according to some embodiments of the present invention. As shown in FIG. 2C, the cascoded transistor circuit includes transistor M2 coupled in series with transistor M1. Further, transistor M2 is also biased with a bias voltage VBIAS. Depending on the embodiments, bias voltage VBIAS can be a fixed or switched bias voltage. The cascoded circuit is configured to perform similar functions as a single transistor M1'. Cascoding MOSFETs can enhance the output impedance of the MOSFET, compared with the single non-cascoded MOSFET. A higher output impedance of the MOSFET can result in a higher gain, better linearity, and better power supply noise rejection, leading to better performance of analog circuits.

Figure 2D:
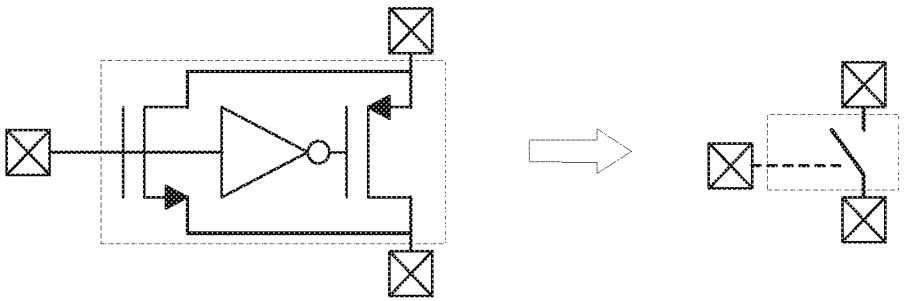
FIG. 2D is a schematic diagram illustrating a switch circuit according to some embodiments of the present invention.

FIG. 2D is a schematic diagram illustrating a switch circuit according to some embodiments of the present invention. The switches described above, such as switches 211, 212, and 213 in FIG. 2A, and the switches in FIG. 2B can be implemented using different semiconductor switch circuits. In an embodiment, the switches can be implemented using a CMOS switch circuit including an NMOS transistor and a PMOS transistor, as shown in FIG. 2D.

Figure 3B:
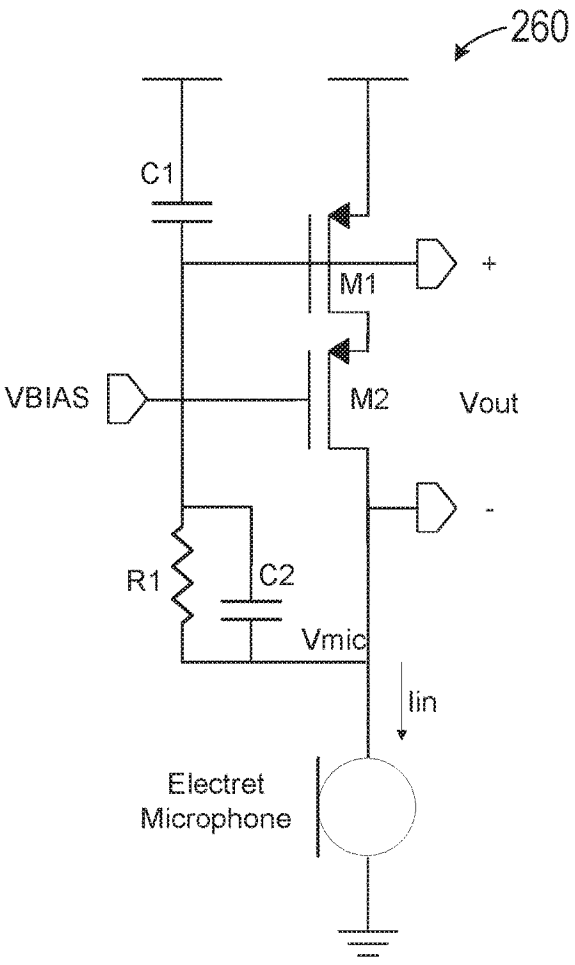
FIG. 3B is a circuit diagram illustrating the interface circuit 250 of FIG. 2B in a power up state according to alternative embodiments of the present invention.
Figure 3A:
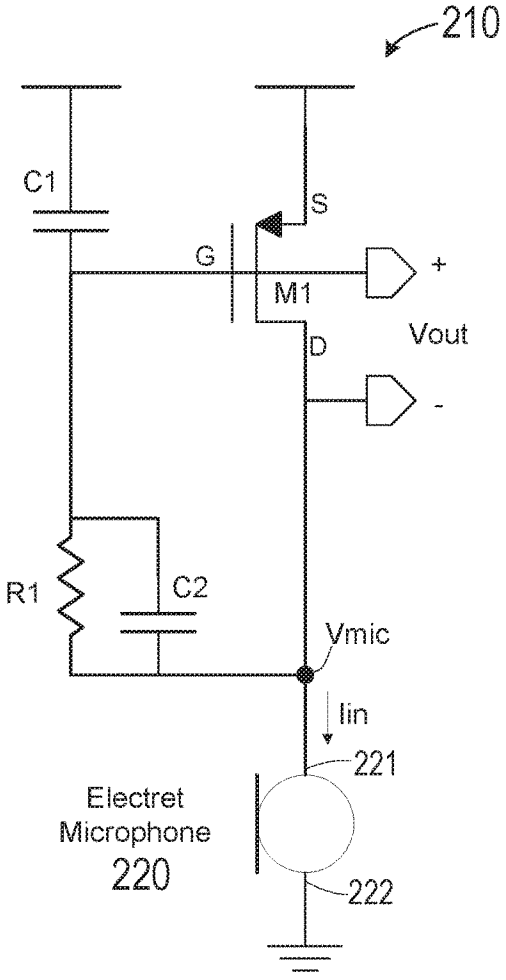
FIG. 3A is a circuit diagram illustrating the interface circuit 210 of FIG. 2A in a power up state according to some embodiments of the present invention.

FIG. 3A is a circuit diagram illustrating the interface circuit 210 of FIG. 2A in a power up state according to some embodiments of the present invention. As shown in FIG. 3, the first switch 211, the second switch 212, and the third switch 213 are not shown, because they are turned on, or closed. In this configuration, interface circuit 210 functions as a bias circuit configured to provide a current Iin to activate microphone 220. When microphone 220 is activated, the voltage at the first terminal 221 of microphone 220 is designated as Vmic. The output signal representing the detected acoustic energy is Vout between the gate G and drain D of MOS transistor M1.

The first switch 211 and the second switch 212 are configured to intermittently, or periodically, provide a current to activate the microphone to detect acoustic energy in a low-power operation mode in response to a pulsed microphone power-up signal PU. During the time period in which the microphone is activated, the microphone can detect acoustic energy. During the time period in which the microphone is deactivated, the microphone is not functional, and the system is in a low-power or power saving mode. After detection of acoustic energy, interface circuit 210 maintains the microphone in the activated state for acoustic energy processing.

In FIG. 2A, a precharge signal is used to control the charging of capacitor C1. In FIG. 3A, Capacitor C1 is already charged up, and the PreCharge signal is not shown. Capacitor C1 is coupled to the drain D of transistor M1. Capacitor C1 is charged to a target DC voltage, which is reached when DC voltages of the drain D and gate G of M1 are equivalent. After the precharge period, power up (PU) signal is used to switch on the microphone detection circuit. In an example, the power up (PU) signal can be a pulsed signal having a 10 μsec power up time in every 125 μsec. In this example, the period of 125 μsec is selected based on the 8 KHz sampling frequency often used in voice processing. However, other suitable activation periods can also be used. During the power up cycle, the microphone signal is amplified and compared using a comparator with a programmable threshold, as described above in connection to FIG. 2A. The result can be latched and output to a TRIGGER signal that can activate the voice detection circuits.

FIG. 3A illustrates microphone interface circuit 210 in a power up state with switches 211, 212, and 213 all closed. At DC, transistor M1 can be considered to have the gate and drain tied together. Therefore, at DC, transistor M1 acts as a diode between the power supply and the microphone. The dimensions of transistor M1 can be programmed or chosen such that the target bias condition of the electret microphone is met. For low frequency signals, M1, with R1 and C1, will also act as a diode, for which the AC impedance is roughly 1/gm1. In some embodiments, M1 is a relatively large device, its AC impedance is relatively small, and low frequency signals can be attenuated compared to higher frequency signals. The frequency response of the circuit are described below with reference to FIGS. 4 and 5.

FIG. 3B is a circuit diagram illustrating the interface circuit 260 of FIG. 2B in a power up state according to alternative embodiments of the present invention. FIG. 3B illustrates microphone interface circuit 260 in a power up state with the switches all closed. Transistor M2 is biased by a bias voltage VBIAS. At DC, transistor M1 can be considered to have the gate and drain tied together. Therefore, at DC, transistor M1 acts as a diode between the power supply and the microphone. The dimensions of transistor M1 can be programmed or chosen such that the target bias condition of the electret microphone is met. For low frequency signals, M1, with R1 and C1, will also act as a diode, for which the AC impedance is roughly 1/gm1. In some embodiments, M1 is a relatively large device, its AC impedance is relatively small, and low frequency signals can be attenuated compared to higher frequency signals. The frequency response of the circuit are described below with reference to FIGS. 4 and 5.

Figure 4:
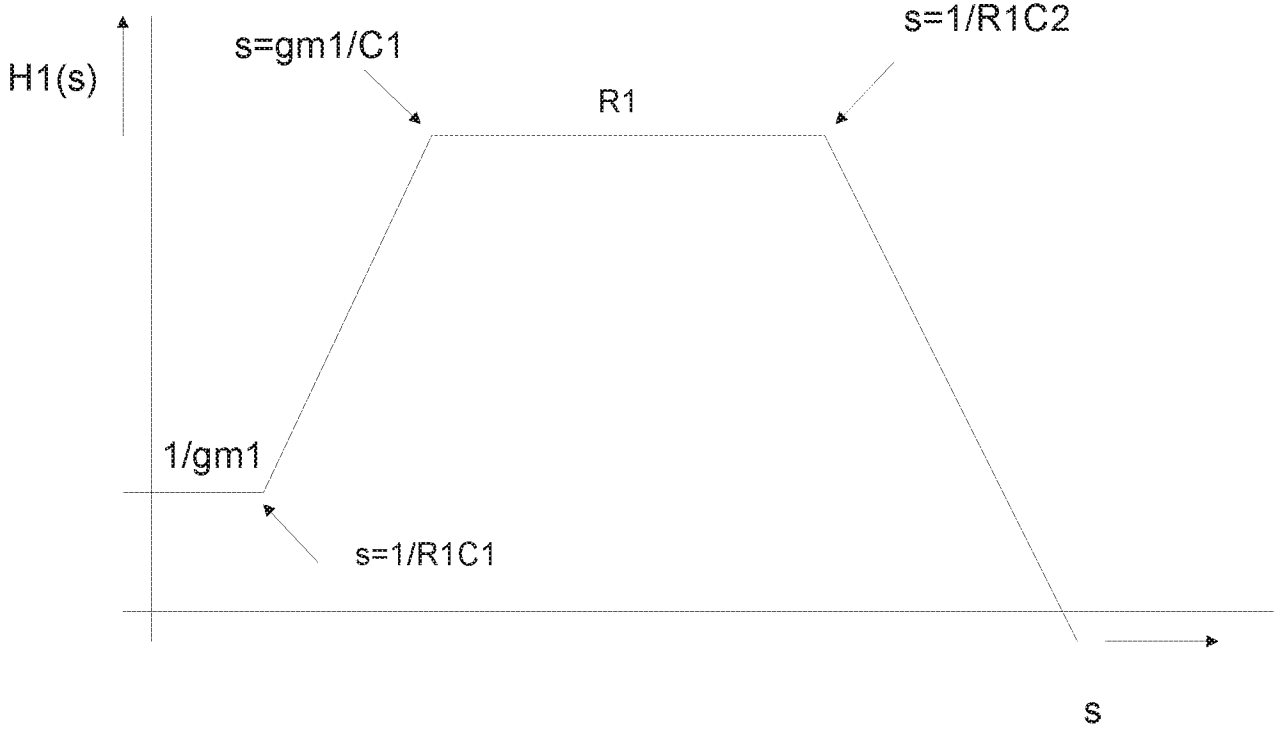
FIG. 4 illustrates a transfer function of the microphone voltage Vmic in FIG. 3A according to some embodiments of the invention.

FIG. 4 illustrates a transfer function of the microphone voltage Vmic in FIG. 3A according to some embodiments of the invention. At higher frequencies beyond the corner frequency of $$Fc1 = \frac{1}{2\pi R1C1},$$

the AC signal from the microphone will be attenuated at the gate of M1. At the corner frequency of $$Fc2 = \frac{1}{2\pi\left(\frac{C1}{gm1}\right)},$$

the microphone signal current will be gained up by R1, provided R1>>rds1, where rds1 is the drain to source resistance of M1. Beyond the corner frequency of $$Fc3 = \frac{1}{2\pi R1C2}$$

the microphone voltage is attenuated again. The transfer function of the Vmic signal can be shown to be as follows.

$$H1(s) = \frac{Vmic}{Iin} = \frac{1 + sR1C1}{gm1(1 + sR1C2)\left(1 + \frac{sC1}{gm1}\right)}.$$

Figure 5:
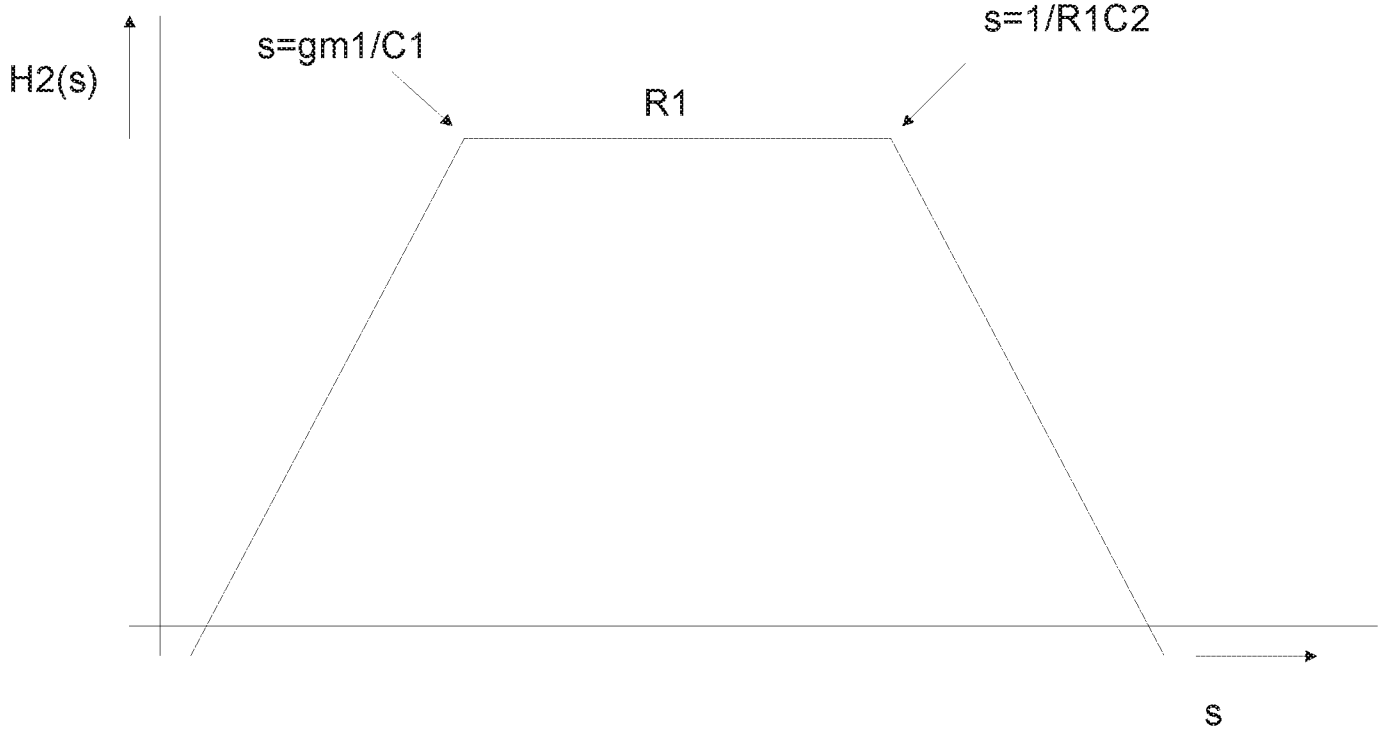
FIG. 5 illustrates a transfer function of the output voltage Vout of the microphone interface circuit 210 in FIG. 3A according to some embodiments of the invention.

FIG. 5 illustrates a transfer function of the output voltage Vout of the microphone interface circuit 210 in FIG. 3A according to some embodiments of the invention. The actual voltage used to process the microphone signal in this circuit is Vout. It has a similar transfer function, except that at frequencies near DC, the signal is highly attenuated. This means that there is no DC component, allowing for further AC processing. The transfer function of output voltage Vout can be shown to be as follows.

$$H2(s) = \frac{Vout}{Iin} = \frac{sR1C1}{gm1(1 + sR1C2)\left(1 + \frac{sC1}{gm1}\right)}.$$

As described above, H2 is the transfer function of the output signal Vout. The high pass and low pass corners can be tuned to match the voice band by adjusting parameters such as, gm1, C1, C2, and R1. The transconductance of transistor M1, gm1, can be tuned by adjusting transistor M1. Further, transistor M1 can be programmable to match the microphone. For example, the current for the microphone is affected by Rds of M1 and R1. In the circuit of FIG. 2A, C1 is a large capacitor and substantially larger than C2. In some cases, C1 can be an off chip capacitor.

Referring back to FIG. 2, microphone interface circuit 210 generates AC samples Vout during the power up time. The magnitudes of the samples are compared using comparator 240 with programmable threshold 250. A decision logic block 260 decides, based on the comparator output, whether a voice trigger should be issued. For instance, decision logic block 260 can simply contain a series of four flipflops to trigger on four consecutive high output levels.

Depending on the embodiments, the power up signal PU can be an intermittent pulsed signal. In some embodiments, the power up signal PU can be a periodic pulse signal having a constant period to turn on the first switch 211 and the second switch 212 to provide a current to the microphone at constant time periods. For example, the microphone power-up signal can have a duty cycle of less than 10% for low-power operation, such that the microphone is turned on less than 10% of the time. In other embodiments, the power up signal PU can be an intermittent pulse signal with variable turn on times to turn on the first switch 211 and the second switch 212 to provide a current to the microphone at variable time periods.

Referring back to FIG. 2A, microphone interface circuit 210 generates AC samples Vout during the power up time. The magnitudes of the samples are compared using comparator 240 with programmable threshold 250. The acoustic energy detection circuit can include latches and a decision logic circuit for keeping track of a number of times the electrical signal exceeds the threshold signal before indicating detection of acoustic energy. A decision logic block 260 can decide, based on the comparator output, whether a voice trigger signal TRIGGER should be issued. For instance, decision logic block 260 can contain a series of four flipflops or latches to trigger on four consecutive high output levels. Even though the above examples are described using an electret microphone, the circuit can be applied to any acoustic energy transducer configured for detecting subsonic, sonic, or supersonic acoustic energy.

Some embodiments of the present invention provide a microphone bias and gain stage with a programmable duty cycle power up and down control. In the embodiments described above, the microphone interface has no capacitor coupling to the microphone. This allows fast charging of the microphone during a brief power up cycle. For the remainder of the cycle, the microphone and associated interface circuit is powered down. The circuit is powered up when a power-up (PU) signal is set high. The power up time when PU is high is typically a fraction of the total cycle time, where the cycle time is related to the sample rate of the analog-to-digital converter (ADC), as follows.

$Tcycle=1/Fs$, where $Fs$ is the sample rate.

$Tpu=Tcycle/N$, where $N>1$.

The above equations show that Tpu can be set to be a fraction of Tcycle.

Figure 6:
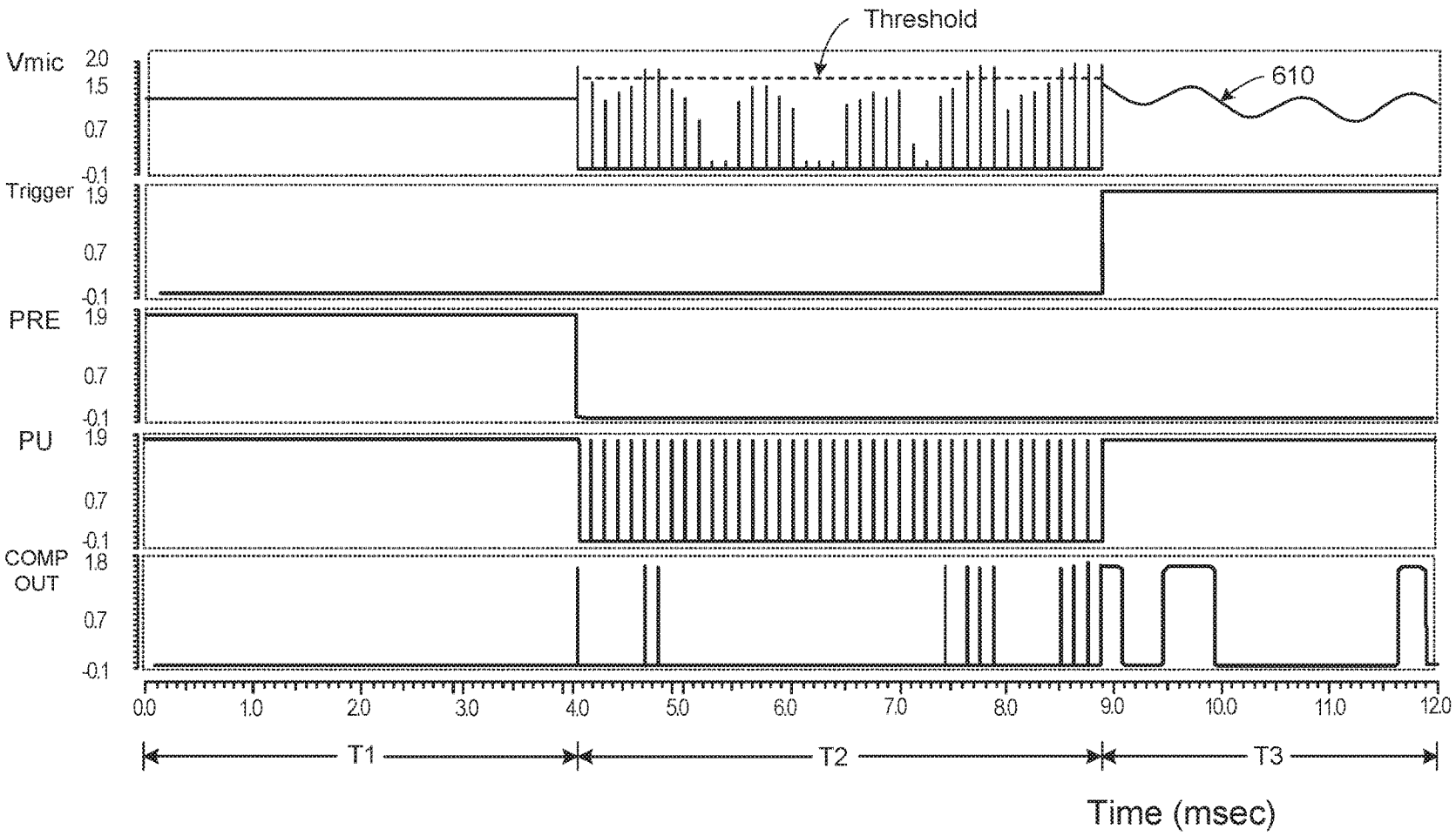
FIG. 6 is a waveform diagram illustrating the operation of the microphone interface circuit 210 of FIG. 2A according to some embodiments of the present invention.

FIG. 6 is a waveform diagram illustrating the operation of the microphone interface circuit 210 of FIG. 2A according to some embodiments of the present invention. FIG. 6 shows the result from a simulation in which the microphone contains a 200 Hz and 1 KHz signal with 2.5 μA peak signal. The power up signal PU has 10 μsec power up time in every 125 μsec. Once the trigger is activated, the sampling stops and the circuit is fully enabled for accurate voice processing. FIG. 6 illustrates the waveforms for the following signals with respect to Time.

Vmic—the voltage at the microphone;

Trigger—the TRIGGER signal, output of the voice signal detection circuit 200;

PRE—precharge signal;

PU—power up signal; and

COMP OUT—output of the comparator.

In FIG. 6, the time in the horizontal axis is divided into three time periods, T1, T2, and T3. During time period T1, the precharge signal PRE and the power up signal PU are up. The microphone interface circuit 210 is in the powered up state. During time period T2, the precharge signal PRE is low, and the power up signal PU issues the pulsed signals intermittently or periodically. In this example, the PU signal has 10 μsec power up time in every 125 μsec. During the 10 μsec time when PU is up, the microphone is detecting voice signals, as shown by the Vmic signal. The voice signal pulses Vmic are compared with the threshold voltage. Every time, the Vmic signal exceeds the threshold signal, the comparator output COMP OUT is high. In this example, the detection logic circuit 260 is set up such that when four consecutive COMP OUT signal pulses are detected, the trigger signal TRIGGER is turned on. In FIG. 6, time period T3 starts when the trigger signal TRIGGER is turned on. During time period T3, the power up signal PU stays on, and the microphone continuously detect voice signals, which is shown as the continuous curve 610.

In another simulation study, the trigger does not become enabled. In this case, the microphone contains a 200 Hz and 1 KHz signal with 0.25 μA peak signal. The circuit draws 4.5 μA of current which is 8 μW at 1.8 V supply. This example shows the low power consumption of the circuit during voice detection operation, as a result of the periodic or intermittent activation of the microphone.

Figure 7:
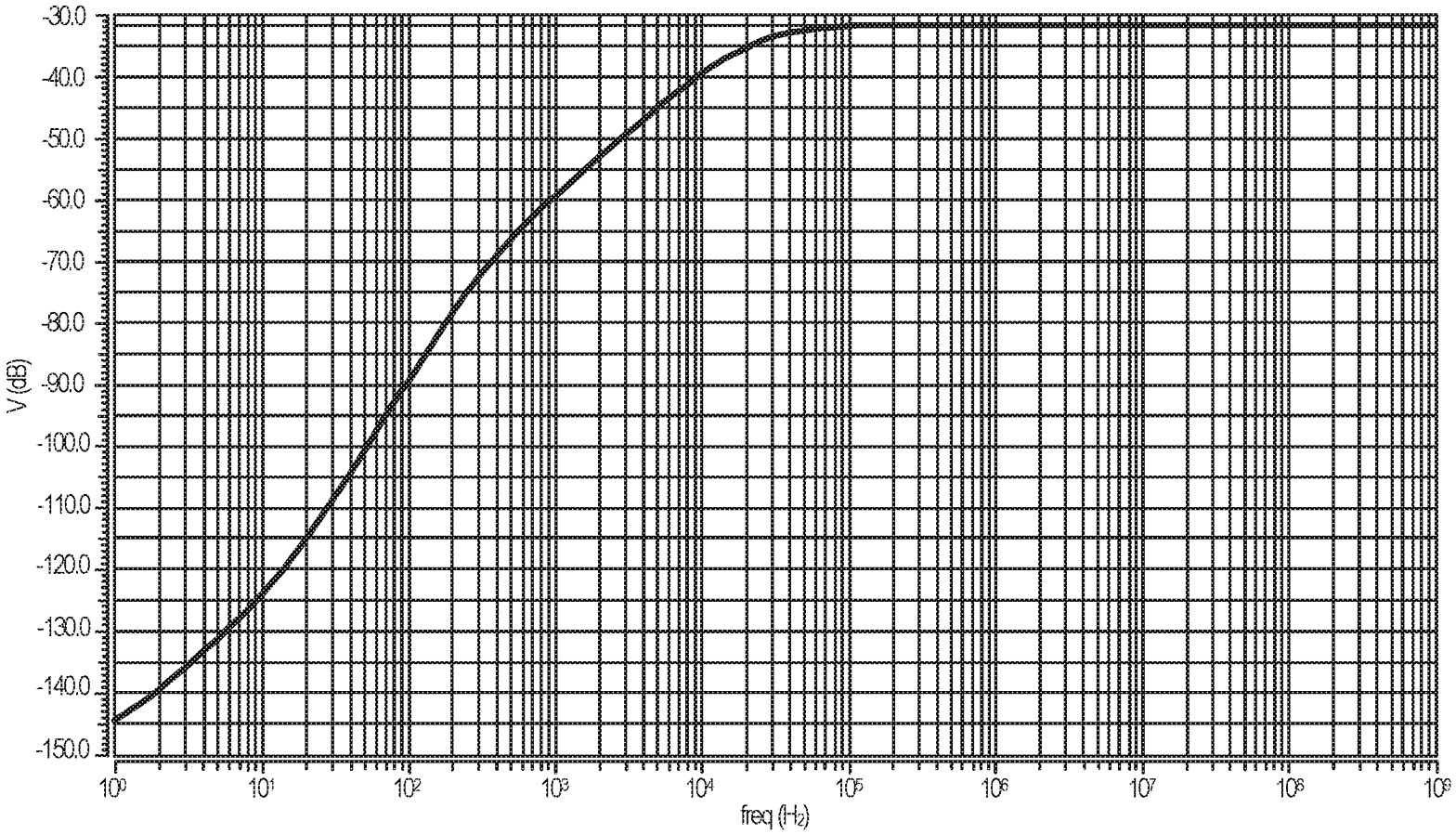
FIG. 7 is a diagram that illustrates the power supply rejection properties of the circuit according to some embodiments of the invention.

FIG. 7 is a diagram that illustrates the power supply rejection properties of the circuit according to some embodiments of the invention. As the drain and gate voltage of the PMOS transistor M1 are equal due to the diode connection, the power supply rejection ratio (PSRR) at DC is expected to be large. FIG. 7 shows a simulation result of Vout/Vsupply versus frequency, which can be correlated to PSSR. The gain would need to be factored in order to calculate the PSRR. In this simulation, the power supply noise is normalized to 1V. FIG. 7 shows approximately 145 db rejection at DC.

Figure 8:
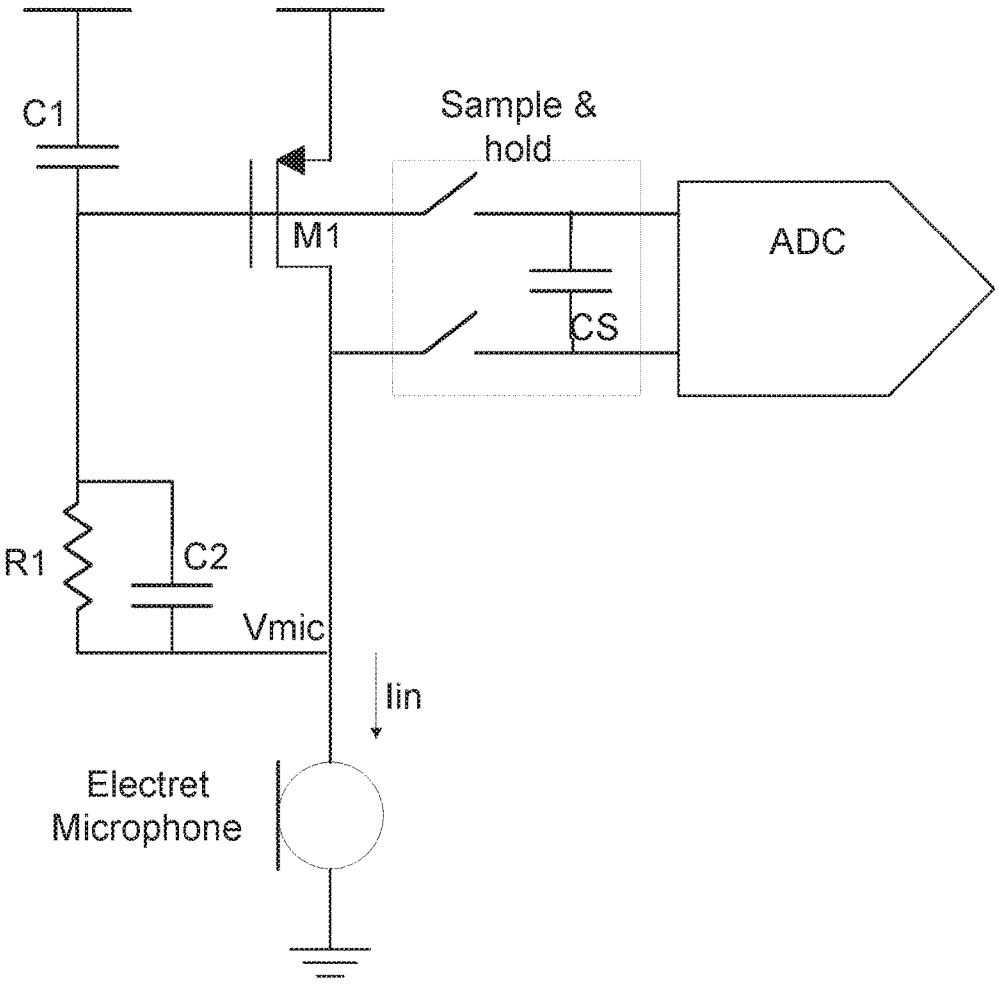
FIG. 8 is a simplified schematic diagram of an audio system having a microphone interface circuit coupled with an analog-to-digital converter according to some embodiments of the present invention.
Figure 9:
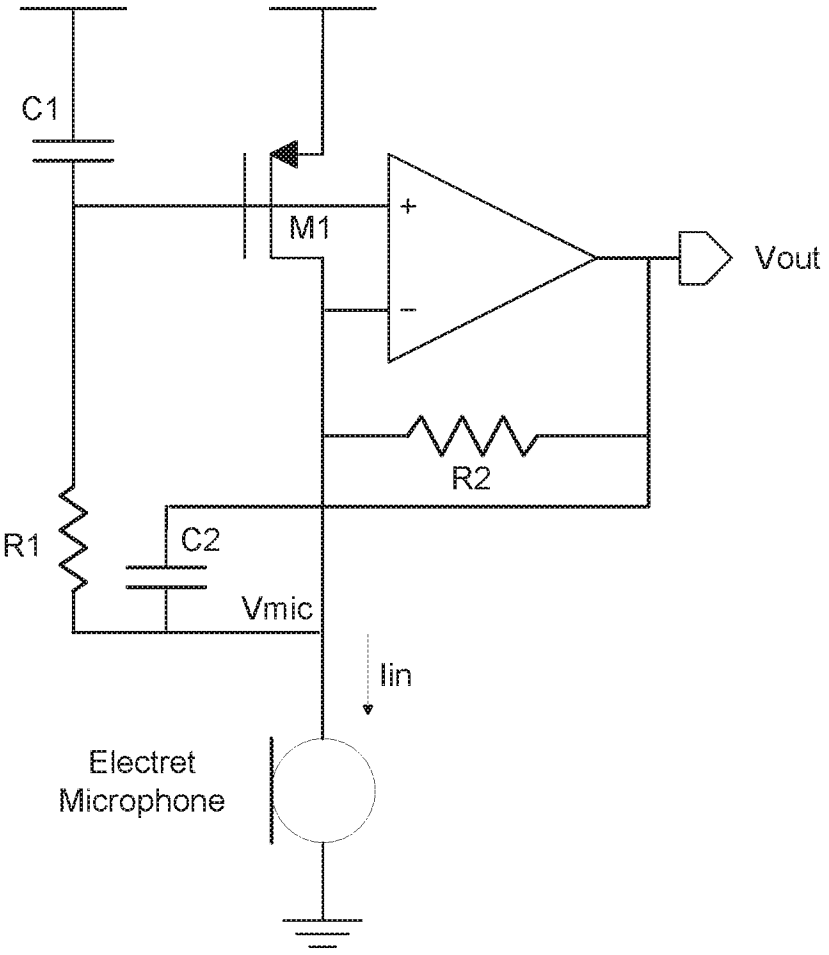
FIG. 9 is a simplified schematic diagram of audio system having a microphone interface circuit coupled with an operational amplifier according to some embodiments of the present invention.
Figure 10:
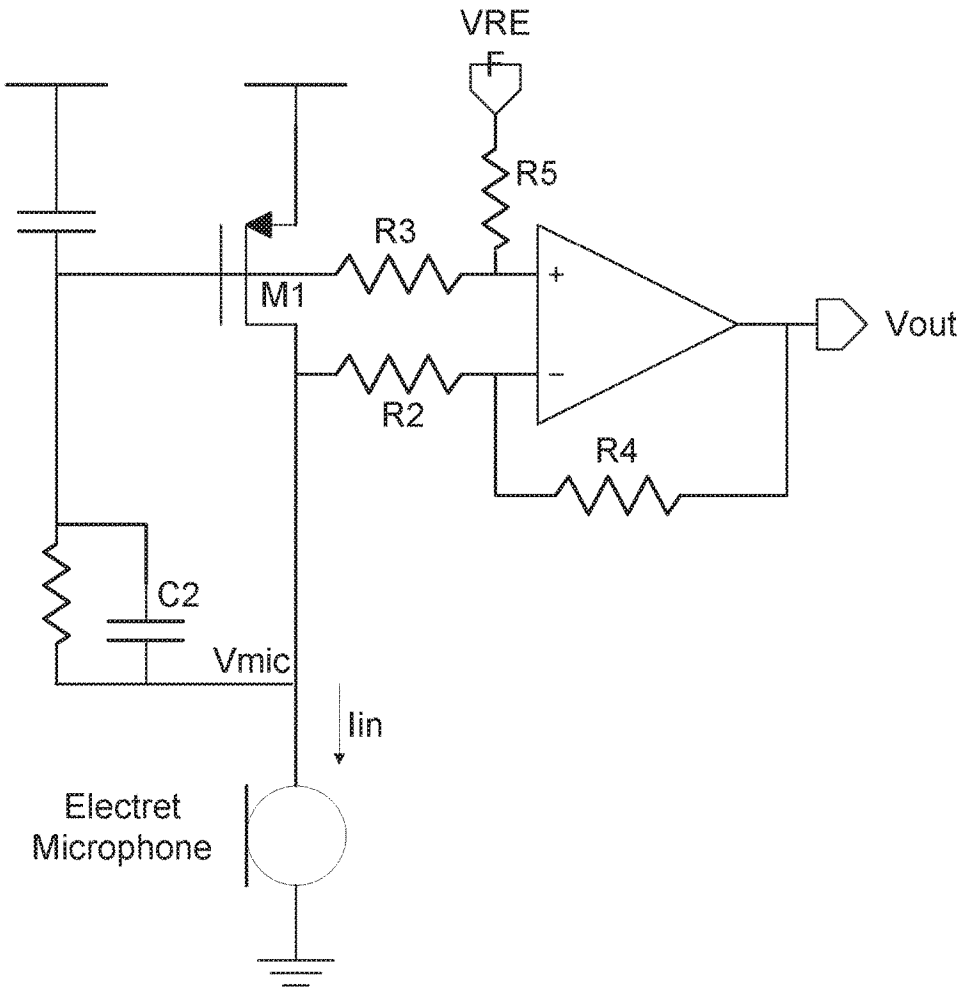
FIG. 10 is a simplified schematic diagram of another audio system having a microphone interface circuit coupled with an operational amplifier according to some embodiments of the present invention.

FIGS. 8-10 are simplified schematic diagrams showing examples for further processing of the AC signal in the power up state after the trigger has activated. These interface circuits are merely for illustration of how they can be used as interface to this invention. For example, further signal processing of the audio signal can be carried by using an ADC (analog-to-digital converter) or OpAmp (operational amplifier) stage. These elements can be enabled once the voice trigger has triggered. Examples are shown below.

FIG. 8 is a simplified schematic diagram of an audio system having a microphone interface circuit coupled with an analog-to-digital converter according to some embodiments of the present invention.

FIG. 9 is a simplified schematic diagram of audio system having a microphone interface circuit coupled with an operational amplifier according to some embodiments of the present invention.

FIG. 10 is a simplified schematic diagram of another audio system having a microphone interface circuit coupled with an operational amplifier according to some embodiments of the present invention.

Even though embodiments of the invention have been described using various specific examples, it is understood that numerous modifications can be made to the embodiments within the purview of the invention. It is also understood that various device, circuit, or logic components in the above examples can be replaced by equivalent alternative components known to those of ordinary skill in the art.

While the above is a description of specific embodiments of the invention, the description should not be taken as limiting the scope of the invention. It is understood that the examples and embodiments described herein are for illustrative purposes only and that various modifications or changes can be made in light thereof.

What is claimed is:

1. A microphone interface circuit, comprising:

a field effect transistor (FET); and a first switch and a second switch for coupling the FET to an electret microphone for intermittently detecting acoustic energy;

wherein the FET is configured to:

provide a DC bias current to the electret microphone;

receive a same DC bias voltage on a gate connection and a drain connection of the FET; and provide output audio samples between the gate connection and drain connection for further processing.

2. The microphone interface circuit of claim 1, further comprising a bias circuit, wherein:

the field effect transistor (FET) has a source connection configured for coupling to a first power supply terminal;

the first switch coupled to the drain connection of the FET, the first switch also configured for coupling to a first terminal of the microphone, the microphone having a second terminal for coupling to a second power supply terminal;

the bias circuit has a first capacitor coupled in series with an RC circuit, the RC circuit having a parallel combination of a resistor and a second capacitor, the first capacitor configured for coupling between the first power supply terminal and the gate connection; and the RC circuit is coupled between the gate connection and the second switch, the second switch also configured for coupling to the first terminal of the microphone, wherein the microphone interface circuit is configured for receiving a microphone power-up signal for intermittently turning on and off the first switch and the second switch for activating and deactivating the microphone.

3. The microphone interface circuit of claim 2, further comprising a third switch coupled between the first capacitor and the drain of the FET, where the third switch is configured to receive a precharge signal for charging up the first capacitor.

4. The microphone interface circuit of claim 2, wherein the microphone power-up signal is a pulsed control signal having a duty cycle between 0% and 100% for low-power operation.

5. The microphone interface circuit of claim 2, wherein the microphone power-up signal is a pulsed control signal having variable periods of on time and off time.

6. The microphone interface circuit of claim 1, wherein the field effect transistor comprises a first transistor and a second transistor coupled in series in a cascaded configuration.

7. The microphone interface circuit of claim 6, wherein the second transistor is coupled to a bias voltage.

8. The microphone interface circuit of claim 1, the first switch and the second switch each comprises a CMOS switch having an NMOS transistor and a PMOS transistor coupled in parallel.

9. The microphone interface circuit of claim 1, wherein the first switch and the second switch have a switching frequency that is twice a targeted bandwidth of the acoustic energy to be detected.

10. The microphone interface circuit of claim 1, wherein the microphone comprises an acoustic energy transducer configured for detecting subsonic, sonic, or supersonic acoustic energy.

11. A microphone interface circuit, wherein:

the microphone interface circuit is configured for capacitor-less coupling to an electret microphone; and the microphone interface circuit comprises:

a single field-effect transistor (FET) configured to provide a current to activate the electret microphone to detect acoustic energy, wherein:

the single field-effect transistor (FET) is also configured to, after detection of acoustic energy, amplify AC signal from the electret microphone and provide an amplified output audio signal for further processing; and the single field-effect transistor (FET) has a source connection, a gate connection, and a drain connection, the source configured for coupling to a first power supply terminal;

a first switch coupled to the drain connection of the FET, the first switch also configured for coupling to a first terminal of the microphone, the microphone having a second terminal for coupling to a second power supply terminal; and a bias circuit having a first capacitor coupled in series with an RC circuit, the RC circuit having a parallel combination of a resistor and a second capacitor, the first capacitor configured for coupling between the first power supply terminal and the gate connection, the RC circuit being coupled between the gate connection and a second switch, the second switch also configured for coupling to the first terminal of the microphone, wherein the microphone interface circuit is configured for receiving a microphone power-up signal for intermittently turning on and off the first switch and the second switch for activating and deactivating the microphone.

12. An acoustic energy detection circuit, comprising:

a microphone interface circuit configured for coupling to an electret microphone, wherein the microphone interface circuit is configured to intermittently provide a bias current to the electret microphone to detect acoustic energy and convert the acoustic energy to an electrical signal; and a comparator circuit for receiving the electrical signal and comparing the electrical signal with a threshold signal, the comparator circuit configured to output an output signal to indicate detection of acoustic energy;

wherein the microphone interface circuit comprises:

an MOS transistor having a source, a gate, and a drain, the source configured for coupling to a first power supply terminal;

a first switch coupled to the drain of the MOS transistor, the first switch also configured for coupling to a first terminal of the microphone, the microphone having a second terminal for coupling to a second power supply terminal;

a bias circuit has a first capacitor coupled in series with an RC circuit, the RC circuit having a parallel combination of a resistor and a second capacitor, the first capacitor configured for coupling to the first power supply terminal; and the RC circuit is coupled between the gate and the second switch, the second switch also configured for coupling to the first terminal of the microphone, wherein the microphone interface circuit is configured for receiving a microphone power-up signal for periodically turning on and off the first switch and the second switch for activating and deactivating the microphone.

13. The acoustic energy detection circuit of claim 12, where the acoustic energy detection circuit is configured to:

precharge the microphone interface circuit in response to a precharge signal;

intermittently provide a current to activate the microphone to detect acoustic energy in a low-power operation mode in response to a pulsed microphone power-up signal; and after detection of acoustic energy, maintain the microphone in an activated state for acoustic energy processing.

14. The acoustic energy detection circuit of claim 12, wherein the microphone interface circuit is configured to provide a current to the microphone at constant time periods.

15. The acoustic energy detection circuit of claim 12, wherein the microphone interface circuit is configured to provide a current to the microphone at variable time periods.

16. The acoustic energy detection circuit of claim 12, wherein the microphone interface circuit further comprises: a third switch coupled between the first capacitor and the drain of the MOS transistor, where the third switch is configured to receive a precharge signal for charging up the first capacitor.

17. The acoustic energy detection circuit of claim 12, wherein the microphone power-up signal has a duty cycle of less than 10% for low-power operation.

18. The acoustic energy detection circuit of claim 12, further comprising latches and a decision logic circuit for keeping track of a number of times the electrical signal exceeds the threshold signal before indicating detection of acoustic energy.

* * * * *